US008827194B2

(12) United States Patent
Domanico et al.

(10) Patent No.: US 8,827,194 B2
(45) Date of Patent: Sep. 9, 2014

(54) FLUORESCENT BULB COMPACTOR AND MERCURY VAPOR RECOVERY SYSTEM

(75) Inventors: Edward J. Domanico, Fort Lauderdale, FL (US); John Greening, Worcestershire (GB); Chris Lawrence, West Yorkshire (GB); Neil McGowan, West Yorkshire (GB); James Schaffer, Bradenton, FL (US)

(73) Assignee: Killgerm Group Limited, West Yorkshire (GB)

( * ) Notice: Subject to any disclaimer, the term of this patent is extended or adjusted under 35 U.S.C. 154(b) by 2238 days.

(21) Appl. No.: 11/278,516

(22) Filed: Apr. 3, 2006

(65) Prior Publication Data

US 2006/0214039 A1 Sep. 28, 2006

Related U.S. Application Data

(63) Continuation-in-part of application No. 10/799,350, filed on Mar. 12, 2004, now Pat. No. 7,118,056, which is a continuation-in-part of application No. 10/330,814, filed on Dec. 27, 2002, now abandoned, which is a continuation of application No. 09/540,410, filed on Mar. 31, 2000, now abandoned.

(60) Provisional application No. 60/127,381, filed on Apr. 1, 1999.

(51) Int. Cl.
*B02C 19/00* (2006.01)
*B02C 21/00* (2006.01)

(52) U.S. Cl.
USPC ..... 241/37.5; 241/99

(58) Field of Classification Search
USPC ..... 241/37.5, 99, 100, DIG. 14
See application file for complete search history.

(56) References Cited

U.S. PATENT DOCUMENTS 4,200,240 A * 4/1980 Machuron ..... 241/37.5
4,213,569 A * 7/1980 Amiot ..... 241/37.5
4,579,287 A * 4/1986 Brown ..... 241/36

(Continued)

FOREIGN PATENT DOCUMENTS

JP 61-029846 2/1986
JP 61-153188 7/1986

(Continued)

OTHER PUBLICATIONS

WO2008/004129 A3 w/ International Search Report attached, Jan. 30, 2008.

(Continued)

*Primary Examiner* — Faye Francis
(74) *Attorney, Agent, or Firm* — Skaar Ulbrich Macari, P.A.

(57) ABSTRACT

A fluorescent bulb compactor and mercury vapor recovery system that allows for the safe collection and disposal of crushed or broken fluorescent lamps, while recovering substantially 100% of the hazardous mercury vapors contained within the lamps. A fluorescent lamp is inserted within a drum and broken into fragments by one or more blades, with the fragment falling to the bottom of the drum. The mercury vapors that are emitted from the broken fluorescent lamps are forced out of the drum by negative positive pressure created by a vacuum/filter assembly. Once through the filter assembly, which includes a HEPA filter and activated carbon filter, the gases are permitted to escape into the environment virtually 100% free of mercury toxins.

17 Claims, 7 Drawing Sheets

(56) References Cited

U.S. PATENT DOCUMENTS

| | | | | | |
|---|---|---|---|---|---|
| 4,655,404 | A | | 4/1987 | Deklerow | |
| 5,090,628 | A | * | 2/1992 | Porter | 241/36 |
| 5,092,527 | A | * | 3/1992 | Perry et al. | 241/19 |
| 5,205,497 | A | * | 4/1993 | Deklerow | 241/36 |
| 5,575,429 | A | | 11/1996 | Muller-Girard | |
| 5,743,473 | A | | 4/1998 | Gregg | |
| 5,769,336 | A | | 6/1998 | Emmerson | |
| 5,833,151 | A | * | 11/1998 | Doak | 241/37.5 |
| 5,887,807 | A | * | 3/1999 | Beinecke | 241/36 |
| 5,899,395 | A | * | 5/1999 | Deklerow | 241/36 |
| 6,581,858 | B1 | | 6/2003 | Deklerow et al. | |
| 7,118,056 | B2 | | 10/2006 | Domanico | |
| 2005/0145730 | A1 | | 7/2005 | Domanico | |
| 2005/0147542 | A1 | | 7/2005 | Domanico | |

FOREIGN PATENT DOCUMENTS

| | | |
|---|---|---|
| JP | 61-187251 | 11/1986 |
| JP | 10-099712 | 4/1998 |
| JP | 2000-237624 | 5/2000 |
| JP | 2001-259465 | 9/2001 |
| WO | WO2005/120159 A2 | 12/2005 |
| WO | WO2008/004129 A2 | 1/2008 |

OTHER PUBLICATIONS

WO2005/120159 A3 w/ International Search Report attached, Apr. 28, 2006.

WO2008/004129 Written Opinion of International Search Authority, Oct. 3, 2008.

WO2005/120159 Written Opinion of International Search Authority, Sep. 12, 2006.

"Recycling Today for a Cleaner Tomorrow Recycling Services and Equipment," Air Cycle, www.aircycle.com, 8 pgs.

"Nikro Mercury Recovery Vacuums," Nikro Industries, Inc., www.nikro.com, at least by Nov. 4, 2003, 2 pgs.

"Crushing Lamps for Disposal & Recycling," Building Services Management, Aug. 2002, 2 pgs.

"InfoPak" for E-Lampinator, Community Environment Alliance, www.communityenvironmentalliance.com, Jun. 27, 2008, 3 pgs.

* cited by examiner

FLUORESCENT BULB COMPACTOR AND MERCURY VAPOR RECOVERY SYSTEM

This application is a continuation-in-part of U.S. application Ser. No. 10/799,350, filed Mar. 12, 2004, now U.S. Pat. No. 7,118,056 which is a continuation-in-part of U.S. application Ser. No. 10/330,814, filed Dec. 27, 2002, now abandoned which is a continuation of U.S. application Ser. No. 09/540,410, filed Mar. 31, 2000, now abandoned which claims priority to and the benefit of U.S. application Ser. No. 60/127,381, filed Apr. 1, 1999, all of the above-identified applications are incorporated by reference.

BACKGROUND OF THE INVENTION

This invention relates generally to the collection, storage and disposal of chemical wastes, especially upon cruise and cargo vessels, and particularly to the collection, storage and disposal of fluorescent lamps and the recovery of mercury vapors emitted from said fluorescent lamps.

There are several problems associated with the collection and disposal of fluorescent lamps, which generate waste on ships and upon large ships in general. The operators, i.e., ship employees, of on-board chemical waste collection and disposal systems are often unknowledgeable about the proper use of present-day waste collection systems. Such operators are typically not aware of procedures for safe and code compliance handling of the waste and, therefore are not able to properly handle storage, movement, leakage or spillage of chemical waste.

Further, the common practice for ship employees to dispose of fluorescent lamps does not include the use of on-board chemical waste collection and disposal systems. Instead, the common practice is to dispose the fluorescent lamps with common non-chemical waste. This procedure results in the breakage of the fluorescent lamps and allows mercury vapors to emit from the fluorescent lamps and contaminate the immediate area thereby possibly intoxicating the ship employees' work area and also possibly causing serious health and safety violations.

The Occupational Safety and Health Administration (OSHA) has set Permissible Exposure Limits (PEL) for the number of air contaminants in the Code of Federal Regulations for Labor and Industry (29 CFR 1910.1000). The PEL's are based upon an 8-hour Time Weighted Average (TWA) concentration. An employees' exposure to a substance for an 8-hour work shift of a 40-hour work week should not exceed the 8-hour TWA PEL for that substance. For substances with a Ceiling Limit, the concentration shall not exceed that limit at any time during the working exposure. For Mercury, the OSHA PEL is, 0.1 mg/m3 (C) pursuant to 29 C.F.R. 1910.1000 (z) (2).

As such, it is highly desirous to provide a chemical waste collection, storage and disposal system for the safe handling of fluorescent lamps upon their useful life ending.

It is therefore, to the effective resolution of the aforementioned problems and shortcomings that the present invention is directed.

SUMMARY OF THE INVENTION

The present invention provides a chemical waste collection and disposal system for fluorescent lamps which preferably includes a drum or container such as a 55-gallon Department of Transportation (D.O.T.) standard drum, a drum lid assembly with handles at the top thereof, a bottom, an interior hollow volume, a fixed lamp tube on the drum-lid for entry of fluorescent lamp tubes, a motor assembly attached on the drum-lid, a vacuum/filter unit attached on the side of the drum preferably near the top, and a filter located at the exterior of the side near the top of the drum.

The lamp disposal system can be preferably mounted on the drum to allow for the safe collection and disposal of properly crushed fluorescent lamps, while recovering approximately 100% or at least a substantial amount of the hazardous mercury vapors. Any length or shape of fluorescent lamps can be disposed of, such as standard one inch and four or eight foot lamps and u-shaped lamps. Where a standard 55-gallon drum is used, the present invention can dispose of approximately 600 four foot lamps, though such number is not limiting. Thus, the present invention may be utilized to safely collect and store any length fluorescent lamp, including standard 4 and 8-foot lamps, 1" lamps and other shapes of lamps.

In use, a fluorescent lamp is inserted into an opening of the fixed lamp tube assembly or other lamp feeder, preferably located at the top of the tube disposal system. Upon reaching the bottom opening of the fixed lamp tube or feeder, the fluorescent lamp is met by a spinner assembly or the like, that is driven by a motor assembly. Rotating at a sufficient amount of revolutions per second, one or more blades of the spinner assembly, breaks the fluorescent lamp into fragments that collect at the bottom of the drum.

At least a substantial amount, and preferably approximately 100%, of the mercury vapors that are emitted from the broken fluorescent lamps are preferably forced out of the drum with positive pressure created by the vacuum/filter assembly. Once through the vacuum/filter assembly, the vapors exit said vacuum/filter assembly and preferably enter an activated carbon filter, other filtering assembly, or the like. Upon the gases and vapors filtering through the activated carbon filter, they escape out of a vent member virtually 100% free of mercury toxins, as the toxins remain with the carbon filter.

The controls of the instant invention allow for fluorescent lamps to be safely disposed of while maintaining concentrations of mercury within the ceiling limit established by OSHA. Preferably, one lamp is inserted through the assembly at a time. However, it is considered within the scope of the invention to inserted more than one lamp through the assembly (i.e. through a plurality of tube feeders are a single tube feeder sufficient in size to receive more than one lamp at a time. In such alternative embodiment, the size of the components such as the tube assembly will be adjusted accordingly. It is also within the scope of the invention, to use the present invention for the disposal of other potential hazardous objects, such as but not limited to, other lamps and bulbs. With these alternative uses, certain components like the activated carbon may be replaced, where applicable, with a more appropriate chemical needed for neutralizing or retaining the additional hazardous material, which may not be mercury.

Thus, the present invention provides a chemical waste collection and disposal system for fluorescent lamps which preferably includes a 55-gallon drum having a drum lid assembly, a fixed lamp tube on the drum-lid for entry of fluorescent lamp tubes, a motor assembly attached on the drum-lid, a vacuum/filter unit attached on the side of the drum preferably near the top, and a filter located at the exterior of the side near the top of the drum. The system allows for the safe collection and disposal of crushed or broken fluorescent lamps, while recovering substantially 100% of the hazardous mercury vapors contained within the lamps. Any length fluorescent lamps can be disposed of, such as standard one inch and four or eight foot lamps. In use, a fluorescent lamp is inserted into an opening of the fixed lamp tube assembly. Upon reaching the bottom opening of the fixed lamp tube, the fluorescent lamp is met by a spinner assembly that is driven by a motor assembly. Rotating at a sufficient amount of revolutions per second, one or more blades of the spinner assembly break the fluorescent lamp into fragments that collect at the bottom of the drum. The mercury vapors that are emitted from the broken fluorescent lamps are preferably forced out of the drum with positive pressure created by the vacuum/filter assembly. Once through the vacuum/filter assembly, the vapors exit said vacuum/filter assembly and preferably enter an activated carbon filter or the like. Upon the gases and vapors filtering through the activated carbon filter, they escape out of a vent member virtually 100% free of mercury toxins, as the toxins remain with the carbon filter.

Generally summarizing, the present invention, which can be considered a bulb or lamp compactor can consist of three main components: (1) a bulb breaking or crushing assembly, (2) a vapor filtering assembly, such as a mercury vapor filter assembly; and (3) a waste collection drum or container. The crushing assembly is preferably mounted directly at the top of the collection drum by the drum lid portion of the crushing assembly. A sealing member, such as a rubber gasket, can be provided to form a seal at the connection point between the drum lid and the collection drum. The crushing assembly also include a motor mounted on top of the drum lid with a shaft connected at one end to the motor and extending through the drum lid, by a preferably sealed opening, such that its second end having one or more blades attached thereto is located within the drum for breaking or crushing inserted bulbs, lamps, etc. (collectively referred to throughout the specification and claims as either "bulbs" or "lamps").

Two openings can be provided for the insertion of the bulbs. The first opening is through a fixed tube feeder, with or without an extension, which is preferably for feeding various lengths of linear fluorescent bulbs. The second opening preferably consists of a box-like or rectangular opening shaped member for feeding circline, u-shaped, and other non-linear shaped bulb. Preferably, both of the bulb openings can be sealed when not in use.

The filtering assembly can be attached to the drum by any conventional removable or non-removable attachment manner such as but by brackets, hooks, welding, bands, etc. and all are considered within the scope of the invention. In one embodiment the filter assembly can be physically supported at the top of the drum or drum lid by a bracket member, such as, but not limited to, a metal bracket. Preferably, the filter assembly consists of multi-stage filter members. A hose member or other conduit, preferably flexible, can be attached at one end to the drum lid (to form a sealed connection) such that it is able to draw in air and mercury vapors from broken bulbs. The opposite end of the hose is communication with the filter member for the first stage of the multi stage filtering process. When the motor of the filter assembly is turned on, a vacuum is created (negative pressure), causing air and vapors residing in the drum to travel through the hose and into the filter assembly. Once passing through the series of filters clean and safe air is expelled out of openings in the filter assembly.

The hose member can be a vacuum hose such as, but not limited to an approximately 2" diameter plastic accordion vacuum hose. A pressure gauge can be provided, preferably on the drum-lid, for reading or measuring the pressure level or extent of vacuum created in the drum. A low reading on the gauge may indicate a clog or other possible problems with one or more of the filter members or the hose or the possibility of leak in the crushing unit or drum. In either embodiment, the present invention can be tilted, such as but not limited to an approximately 45 degree angle, through the use of a specially design dolly, which will allow long linear tubes to be fed into the machine without hitting or otherwise interfering with the ceiling of a room where the present invention may be located.

Accordingly, it is an object of the present invention to provide a chemical waste collection and disposal system which is easily operable by a crew aboard a cruise or large ship.

It is another object to provide a chemical waste storage and disposal system which allows for safe and code compliance storage of chemical waste.

It is a yet further object to provide a chemical waste and storage system which is easily transportable off ship for removal and disposal.

It is a yet further object to provide a chemical waste and storage system which is easily movable from drum to drum.

It is a further object of the invention to allow for the safe collection and disposal of fluorescent lamps.

It is still another object of the invention to provide a chemical waste and disposal system in which mercury particles and vapors that are emitted from fluorescent lamps are safely contained upon disposal.

It is a yet further object to provide for the economical transport of chemical waste in unit quantities as close to 55 gallons as possible, for cost-effective operation of the system.

The above and yet further objects and advantages of the present inventive system will become apparent from hereinafter set forth Brief Description of the Drawings and Detailed Description of the Invention.

BRIEF DESCRIPTION OF THE DRAWINGS

The invention may be better understood by reference to the drawings in which.

DETAILED DESCRIPTION OF THE DRAWINGS

Figure 1:
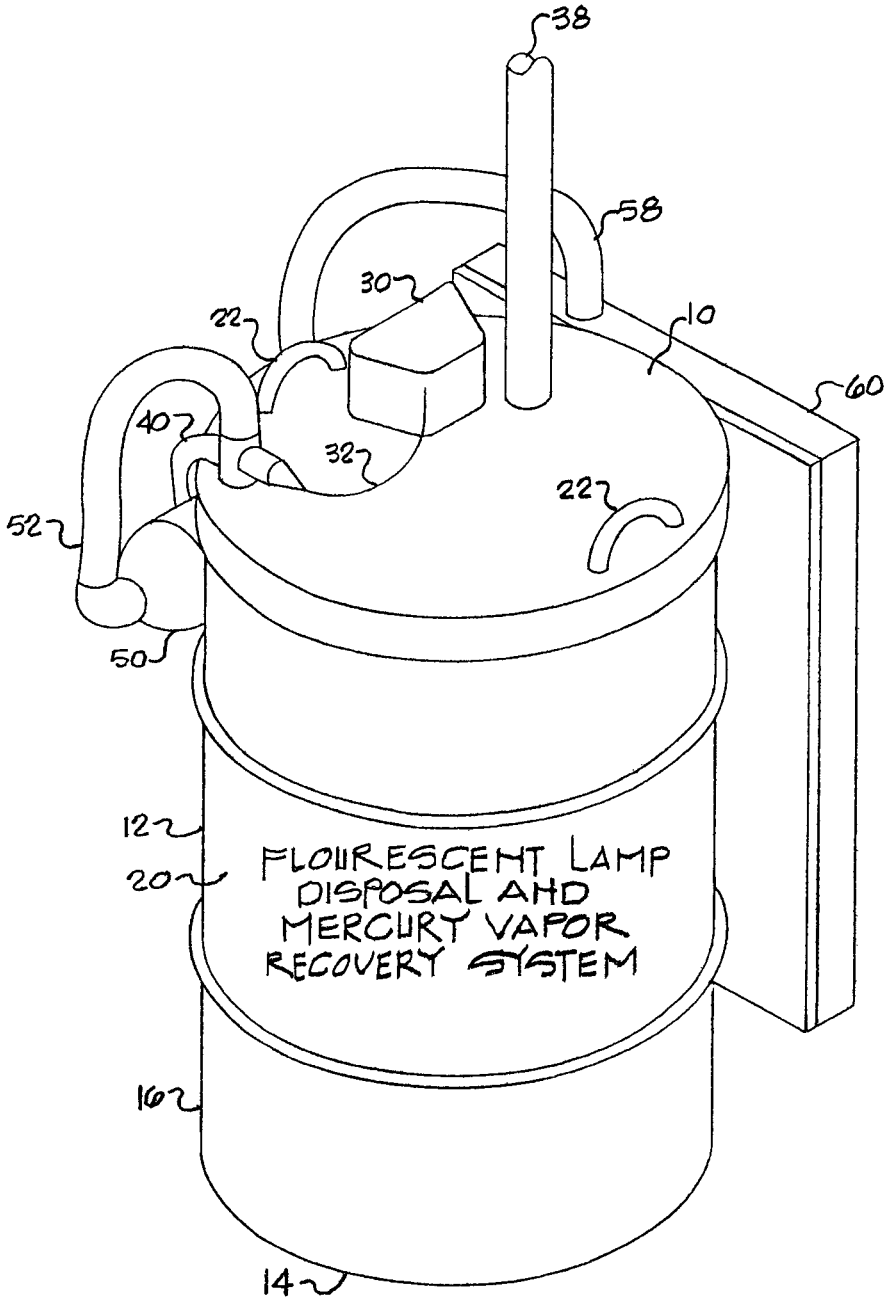
FIG. 1 is a perspective view of a first embodiment of the present invention chemical waste collection, storage and disposal system.

The first embodiment of the instant chemical waste collection and disposal system, as is illustrated in FIG. 1, can comprise a drum lid assembly 10, mounted preferably on a drum or other housing, such as a 55-gallon D.O.T. standard drum 20, having a drum bottom 14, a drum exterior 12, and a drum interior hollow volume 16. The drum-lid assembly 10, includes at least one handle and preferably two handles 22, and a fixed lamp tube 38, preferably shaped to correspond to the shape of the fluorescent lamps, or other items, to be inserted.

Figure 3:
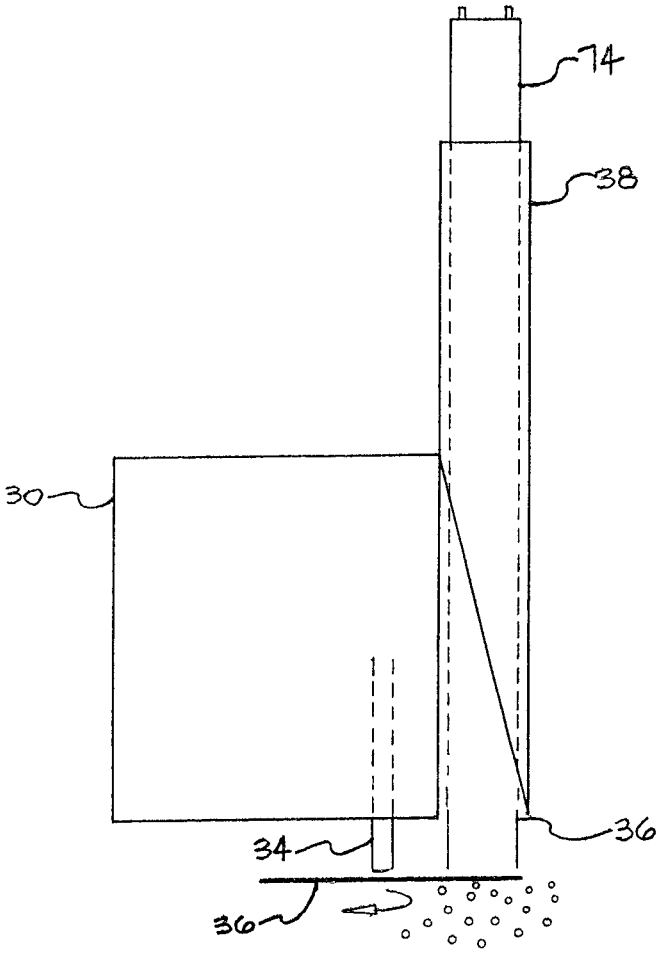
FIG. 3 is a side plan view of FIG. 1, illustrating a motor assembly and a fixed lamp tube.

The fixed lamp tube 38, is preferably adjacent to a motor assembly 30. Motor assembly 30 may be of a 120V or 220V configuration and powered by an electrical cord, other power configurations including battery power are also within the scope of the invention. As illustrated in FIG. 3, the fixed lamp tube 38, preferably has an opening at the top to allow for a fluorescent lamp 70 to be inserted preferably vertically into the opening. Upon reaching the bottom opening of fixed lamp tube 38, the fluorescent lamp is met by a spinner assembly 36, connected to a shaft 34, which is driven by a motor assembly 30. Rotating at a sufficient amount of revolutions per second, the blades of spinner assembly 36, break the fluorescent lamp into fragments that fall to the bottom of the drum, through an opening in the drum cover or lid.

As illustrated in FIG. 1, the mercury vapors that are emitted from the broken fluorescent lamps may be drawn out of the 55-gallon drum by a positive pressure created by the mercury vapor recovery system that features a high-efficiency vacuum system 50, through flexible hose 52. Vacuum/filter assembly 50 is preferably attached to the 55-gallon drum by a bracket 40. The high efficiency vacuum system 50 preferably includes a specially treated H.E.P.A. filter that captures virtually 100% of the mercury, contaminated white powder, considered hazardous. It should be recognized that other appropriate conventional filters can also be used and are considered within the scope of the invention. Preferably, the filters are replaced periodically.

Figure 2:
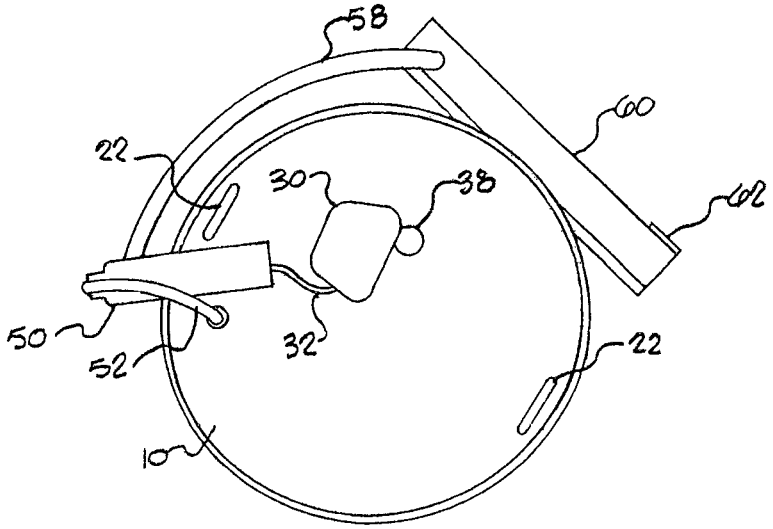
FIG. 2 is a top view of the embodiment illustrated in FIG. 1.

As illustrated in FIG. 2, once drawn through vacuum/filter assembly 50, the vapors then exit the vacuum/filter assembly through flexible hose 58 and then preferably enter a specially treated activated carbon filtering system 60 for final hazardous mercury vapor removal. Other conventional filtering systems can also be used and are considered within the scope of the invention. Upon the gases and vapors filtering through activated carbon filter 60, they are exhausted out of a vent 62 as uncontaminated air, free of harmful mercury toxins, which are retained or neutralized by the filter.

Figure 4:
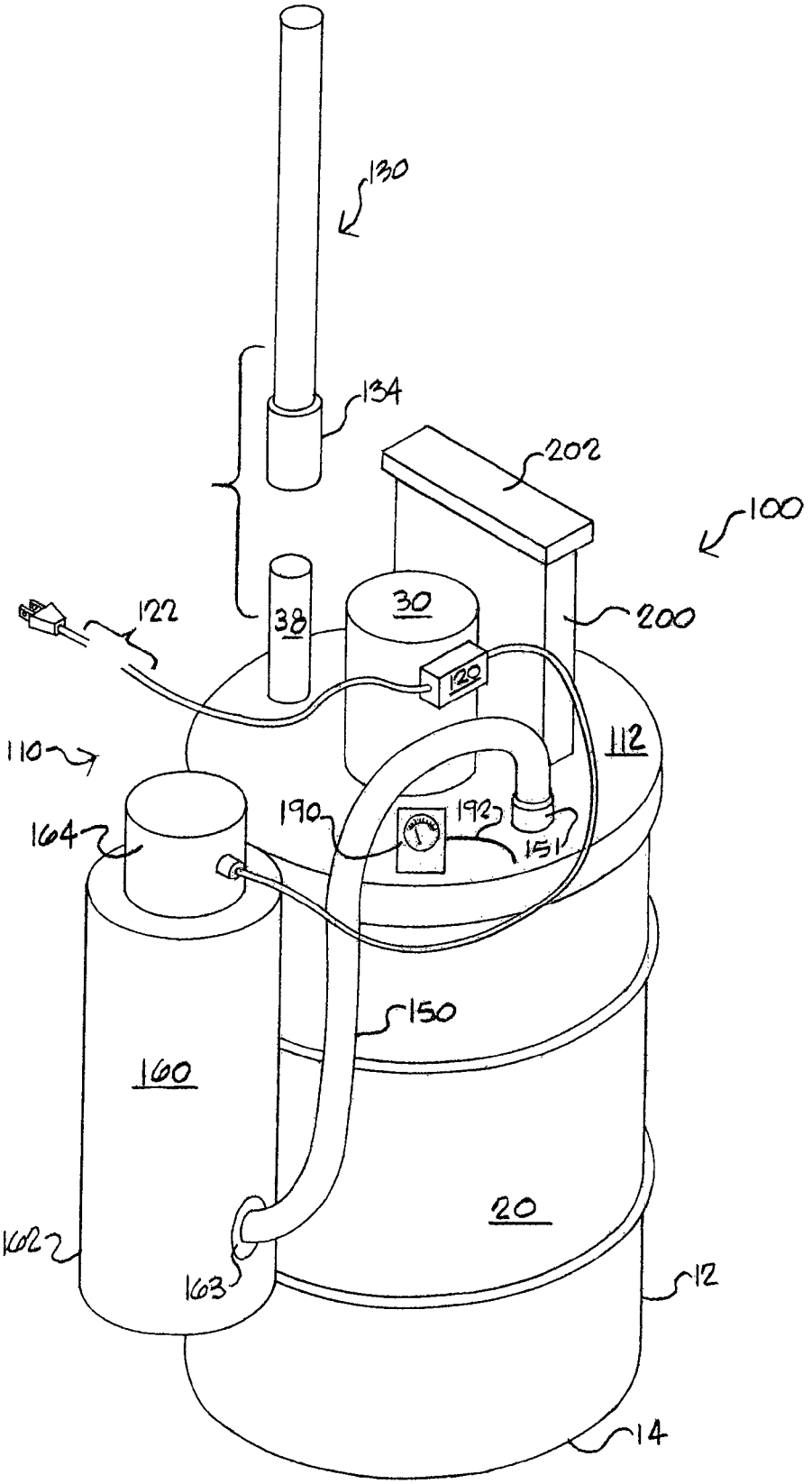
FIG. 4 is a perspective view of a second embodiment of the present invention chemical waste collection, storage and disposal system.
Figure 5:
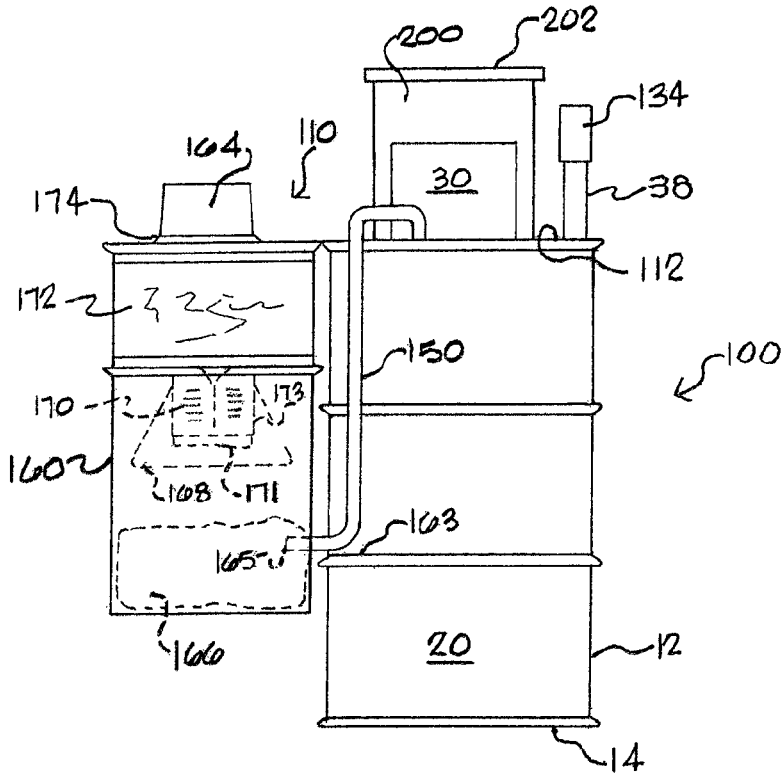
FIG. 5 is a side view of the invention shown in FIG. 4 with a portion of the filtering assembly housing cutaway or section to illustrate the multi-stage filtering members.
Figure 6:
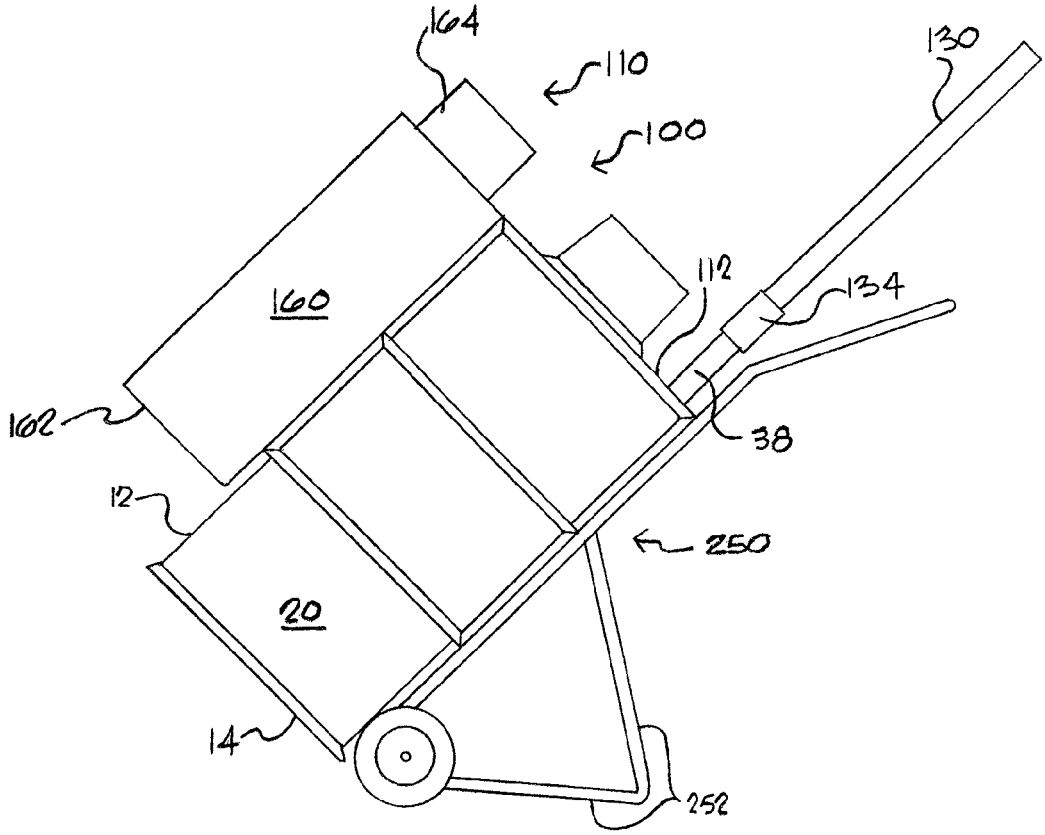
FIG. 6 is a side view of the invention shown in FIG. 4 shown in an inclined position.

The present invention, in the first embodiment includes the following parts and components, namely:

I. Main Drum-Lid Assembly
(a) lid, with fixed lamp tube
(b) lamp tube, loose, with funnel top
(c) lid handle, (2), with ¼-20×1" and 2" screws and locknuts
II. Motor Assembly
(a) motor, replacement, 120v, with top disk, washers, locknuts, switch, no cords
(b) motor, replacement, 120v, with top disk, washers, locknuts, switch, short and long cords
(c) motor, replacement, 120/220v, with top disk, washers, locknuts, switch, no cords
(d) motor, replacement, 120/220v, with top disk, washers, locknuts, switch, short and long cords
(e) spinner assembly, with hub, cable, and set screws
(f) power cord, 18-3 SJT, 40' with wire nuts and strain relief
(g) cord, short, to vacuum filter section cable and connector (6" cord)
(h) switch, on-off toggle switch, with nuts and legend plate, wire nuts
III. Filter/Vacuum Section
(a) vacuum unit, with connectorized cord and screws for mounting to bracket.
(b) vacuum mounting bracket
(c) bracket mounting spacers, (3), ¾ diameter×1"
(d) hose, inlet replacement, with tapered end piece
(e) hose, outlet replacement, with tapered end piece
(f) hose grommets, (2), for lid and carbon canister
(g) filter bags, disposable pre-filters, set of 5
(h) HEPA final filter, cartridge, each
(i) end plates, molded, inlet
(j) end plates, molded, outlet
(k) decal on the filter/vacuum unit
IV. VRS/Carbon Canister Section
(a) carbon canister, without lid/top plate
(b) canister lid/top plate, with screws (5), ¼-20×¾ truss head
(c) foam gasket and 425 canister pad
(d) carbon, activated, 22 pounds
(e) snap-in handle
(f) standoff, mounting for canister, with screws
(g) trim, bottom edge
V. Miscellaneous
(a) safety goggles
(b) gloves, lamp handling As seen in FIGS. 4 through 6, a second embodiment for the present invention is shown and generally illustrated as chemical waste collection and disposal system 100. Like or similar parts from the first embodiment discussed above will be provided with the same reference numerals. Disposal system 100 includes a waste removal assembly 110, mounted preferably on a drum or other housing, such as a 55-gallon D.O.T. standard drum 20, having a drum bottom 14, a drum exterior surface or sidewall 12, and a drum interior hollow volume 16. A drum lid 112 is provided and can include at least one handle and preferably two handles. A fixed lamp tube 38, preferably shaped to correspond to the shape of the fluorescent lamps, or other items, to be inserted can be provided on drum lid 112. Drum lid 112 can be removably secured to drum 20 at the top of the drum 20. Preferably a gasket or other sealing member is provided to create a sealed removable connection between drum lid 112 and drum 20.

Fixed lamp tube 38 can be preferably adjacent to a motor assembly 30. Motor assembly 30 may be of a 110V-120V or 220V configuration, other value and includes a power assembly 120 having an electrical cord 122 for plugging into a wall plug or other power outlet. Other power configurations including, but not limited to, battery and solar power are also within the scope of the invention.

As illustrated in FIG. 4, fixed lamp tube 38 preferably is provided with a top opening and a bottom opening. The top opening allows a fluorescent lamp 70 to be inserted preferably vertically or angled (FIG. 6) into lamp insertion tube 38. Upon reaching the bottom opening of fixed lamp tube 38, fluorescent lamp 70 is permitted to enter the interior of drum 20 and is ultimately met by spinner assembly 36, connected to shaft 34, which is driven by motor assembly 30. Rotating at a sufficient amount of revolutions per second, the blade or blades of spinner assembly 36, break and/or crush fluorescent lamp 70 into fragments that for the most part fall (i.e. a small amount may enter the filter assembly and captured by one of the filter members) to the bottom of the drum. Fixed lamp tube 38 can be connected to drum lid 112 by any conventional means. Fixed lamp tube 38 can be monolithically formed or otherwise constructed integral with drum lid 112. Where monolithically formed or otherwise constructed integral therewith, the bottom opening of fixed tube 38 can be the same opening as the tube insertion opening in drum lid 112. Where fixed tube 38 is not monolithically formed or otherwise constructed integral therewith, a separate drum lid opening may be necessarily and can be aligned with and adjacent to the bottom opening of fixed lamp tube 38 when fixed lamp tube 38 is secured to drum lid 112. A sealing member, such as a gasket, o-ring, etc. can be provided at the point when fixed lamp tube 38 is secured to drum lid 112 if tube 38 is not constructed integral with drum lid 112. The above description regarding the relationship between fixed lamp tube 38 and drum lid 112 is also applicable to the embodiment of the invention shown in FIGS. 1 through 3.

In both embodiments of the invention, motor assembly 30 can be a high speed, industrial strength motor having a shaft attached thereto and with the shaft having one or more heavy duty breaking blades secured thereto.

A tube insertion extender 130 can be provided, for either embodiment, which can be removably secured to fixed lamp tube 38. Extender 130 can be of a substantially tube-like shape and can be provided with a female receiving end 134 that fits over and receives at least an outer top portion of fixed lamp tube 38. Preferably the removable connection of extender 130 to fixed lamp tube 38 can be a sealed connection by a gasket, o-ring, other conventional sealing member. The addition of extender 130 increases safety for the individual inserting the lamps into system 10 or 100, since the point where lamp 70 is broken to the exposed opening 132 of the extender is a relatively longer distance then the top opening of tube 38, in the unlikely event broken glass shot upward into tube 38 after being broke by one or more blades of spinner assembly 36. Female receiving end 134 can be monolithically formed or otherwise constructed integral with the remaining portion of extender 130.

Alternatively, female receiving end 134 can be a separate piece from the rest of extender 130 and can be an adaptor which in use is removably connected at one end (preferably sealed connection) to fixed tube 38 and at it's opposite end to extender 130 (preferably sealed connection). Lastly, it also within the scope of the invention that the female receiving end is monolithically formed or otherwise constructed integral with fixed tube 38 and the remaining portion of extender 130 is removably secured to fixed tube 38 by a removable (and preferably sealed) insertion of extender 130 into the female receiving end 134 of fixed tube 38.

The circular opening for extender 130 and fixed tube 38 can be approximately 2.5 inches in diameter, though other diameter sizes are available and are also considered within the scope of the invention. The diameter size of receiving end/adaptor 134 can be preferably slightly larger than the diameter size of tube 38 or extender 130 to permit receiving end/adaptor 134 to function as the female portion at the connection points and tube 38 and extender 130 to serve as the male portions at their respective connection points with receiving end/adaptor 134. Fixed tube 38, receiving end/adaptor 134 and extender 130 can be constructed from any suitable metal material or any other suitable material.

A second lamp insertion opening in drum lid 112 for feeding certain shaped lamps (e.g. circline, u-shaped, other non-linear and linear shapes, etc.) through drum lid 112 can also be provided. The second opening can be substantially rectangular in shape, though other shapes can be used and are considered within the scope of the invention. Where a substantially rectangular shaped second opening is selected, a box-like member 200 can be provided on drum 112 and aligned with the second lamp insertion opening. A bottom portion of box member 200 can be pivotable between a closed position (preferably sealed) and an open position. A top portion 202 of box member can also be pivotable between a closed position (preferably sealed) and an open position. One or more connecting rods or other connecting members (all collectively referred to as "connecting rods") can be provided and are each attached at one end to the bottom portion of box member 200 and at their opposite end to top portion 202. Thus, when top portion 202 is moved to its open position by a user or other individual ("user"), the length and connection points of the connecting rods cause the bottom portion to move to its closed position (preferably sealed).

In this configuration, the user places the lamp(s) to be crushed (e.g. circline, u-shaped, etc.) into box member 200 and the lamp rest on and/or is supported by the bottom portion. The subsequent moving of top portion 202 by the user into a closed position (preferably sealed), causes the connecting rods to move the bottom portion into an open position which permits the lamp(s) previously contained within box member 202 to fall through the second lamp insertion opening in drum lid 112, where the lamp(s) is(are) met and broken and/or crushed by the one or more blades of spinner assembly 36.

The second tube insertion opening can be approximately 2" by approximately 14" in dimensions, though such is given by way of example and not considered limiting. Accordingly, other dimensions can be used and are considered within the scope of the invention. Additionally, though not limiting, certain dimensions of box member 200 can correspond to or be based from the dimensions of the second tube insertion opening of drum lid 112. Box member 200 can extend vertically approximately 14" from drum lid 112, though again, such dimension is not considered limiting and other heights can be selected and are considered within the scope of the invention.

Preferably, top portion 202 can be in a sealed closed position with respect to box member 200 and the top opening of fixed tube 38 can be sealed when system 10 or 100 is not in use. Fixed tube 38 can be sealed by a conventional plug or cap. Top portion 202 is preferably sealed by a gasket member disposed around box member 200 where it comes in contact with top portion 202 in its closed position. Other conventional sealing devices and members can be used and are considered within the scope of the invention for sealing at fixed tube 38 and/or top portion 202.

A filtering assembly 160 can be attached to drum 20 by any conventional removable or non-removable attachment manner such as but by brackets, hooks, welding, bands, etc. and all are considered within the scope of the invention. In one embodiment, filter assembly 160 can be physically supported at the top of drum 20, and preferably at drum lid 112 by a bracket member attached to or otherwise associated with outer housing 162 of assembly 160. The bracket can be a metal bracket though such is not considered limiting and other suitable materials can be used and are considered within the scope of the invention. Filter assembly 160 preferably provides multi-stage filtering through a plurality of filter members 166, 168, 170 and 172.

A hose member or other conduit 150, preferably flexible, can be attached at one end to the drum lid (to form a sealed connection) such that it is able to draw in air and mercury vapors from broken bulb(s) or lamps(s). The opposite end of hose 150 is in communication with first stage filter member 166 of multi stage filtering assembly 160. When the motor of the filter assembly is turned on, a vacuum is created (negative pressure), causing air and vapors (such as mercury vapors from broken bulbs and lamps) residing in drum 20 to travel through hose 150 and into filter assembly 160. Once passing through the series of filter members of filter assembly 160, clean and safe air is expelled out of openings in filter assembly 160, preferably, though not limiting, at the top of housing 162.

A small tube 151 on drum lid 112 can form a male member that is received by the first end of hose 150 for attached hose 150 to drum lid 112. A bracket member 163 having a hollow male member can be attached to an outer housing 162 of filter assembly 160 and aligned with an opening in filter housing 162. The hollow male member of bracket member 163 is received by the second end of hose for attaching hose 150 to outer housing 162. A small tube member 165 is attached, welded or otherwise connected to the inner wall of outer housing 162 and is aligned with the hollow male member of bracket member 163. Thus, when hose 150 is properly connected communication is provided between the interior of drum 20 and the interior area of outer housing 162. Hose 150 can be preferably connected at a position on drum lid 112 where it can be effective in capturing mercury vapors regardless of whether the lamp or bulb is inserted through fixed tube 38 or box-like member 200. Additionally, spinner assembly 36 is positioned with respect to drum lid 112 such that it is able to breach and/or crush bulbs inserted through fixed tube 38 or box-like member 200.

Thus, mercury vapors that are emitted from the broken fluorescent lamps or bulbs may be drawn out of the 55-gallon drum through hose 150 by negative pressure created by the multi-stage filtering assembly 160 that generally includes outer housing 162, high-efficiency vacuum system 164 and multiple filter members 166, 168, 170 and 172. As seen in FIG. 4, power for vacuum motor 164 can be provided by power supply 120, though other power sources are also within the scope of the invention.

The high efficiency multi-stage filtering begins with disposable collection bag 166, which is connected over small tube 165 so that communication is provided between hose 150 and collection bag 166. Bag 166 collects dry contaminated particulate such as, but not limited to, larger particles, such as pieces of broken glass and dust, that have been drawn in through hose 150 by the negative pressure created by vacuum motor 164. The second stage filtering includes an additional filter bag, such as but not limited to, a non-cling Dacron filter bag 168, which prevents particulates from entering into the additional filtering stages. Filter bag 168 can be provided as a safety in the invention the collection bag 166 is overfilled, burst, or otherwise fails to be performing properly. Furthermore, a secondary paper filter (not shown) can be provided to trap larger size particles (e.g. dust, etc.), which may escape from collection bag 166. The secondary paper filter may also extend the useful life of Dacron filter bag 168. Dacron filter bag 168 can be substantially water repellant and substantially non-clinging to shed off water, soot, and other particulates, thus, protecting HEPA filter 170 from moisture, larger dust particles, etc.

Thus, particulates, which usually are collected in bag 166, are blocked by filter bag 168 (and possibly a secondary paper filter if provided) so they don't harm or otherwise effect the performance of filters 170 and 172. Smaller particulates, air, vapor, etc. that do pass through collection bag 166 and/or filter bag 168 are drawn by the negative pressure created by vacuum motor 164 to a HEPA filter 170, which is protected by a micro impact filter 171, for extending the useful life of HEPA filter 170. Micro impact filter 171 can be in the form of a filter pad and can be composed of specially treated, high efficiency, high density, woven fiberglass designed to capture fine particles before reaching HEPA filter 170.

HEPA filter 170 is preferably provided in a housing member 173, such as, but not limited to, a substantially circular aluminum housing. The length of housing 173 can be longer then the length of HEPA filter 170 to permit micro impact filter 171 to also be housed by housing 173. HEPA filter 170 removes fine particulate from the air and vapor stream. HEPA filter 170 can be rated at 99.97% @ 0.3 micron (by the D.O.P. Test method), though other HEPA filters with different ratings (higher or lower) can be used and are considered within the scope of the invention.

After leaving HEPA filter 170, virtually only gas (air) and mercury vapor remain and continue to be drawn in by vacuum motor 164 and directed to activated carbon filter 172. Activated carbon filter 172 traps or captures the mercury vapor, while permitting the gas (air) to pass through where it is exhausted out to the environment through openings or vents 174 at the top of housing 162. Thus, activated carbon filter 172 traps, retains and/or neutralized virtually all harmful mercury vapor (toxins) to permit filter assembly 160 to exhaust clean air into the environment.

A pressure gauge 190, such as a Minometer or other differential pressure gauge, can be provided to detect potential problem with the operation of one or more components of filter assembly 160 or hose 150, as well as possible leaks. One end of a hose or other conduit or tubing 192 is connected to gauge 190. The opposite end of hose 192 is disposed with the interior of drum 20 through an opening (preferably sealed) in drum lid 112. Hose 192 can be held in place by a clip or other conventional securing member. A "low pressure" reading or other threshold reading by gauge can indicate that vacuum motor 164 is not creating the required negative pressure within drum 20 which could be caused by a leak, one of the filters or charcoal bed requiring replacement or cleaning, hose 150 being clogged, etc. Pressure gauge 190 can be mounted on top of drum lid 112 by any conventional mounting member.

Lastly, a trolly/dolly 250 ("dolly") can be provided for transporting system 10 or 100. Additionally, dolly 250 can be provided with flanges 252, which allow dolly to be maintained at an angled resting position. The angled position provides more clearance from the ceiling (i.e. low ceiling environments like on a cruise ship, etc.) for feeding lamps, especially long length lamps, into extender 130 and/or fixed tube 38. In one embodiment, the resting angle can be approximately 45 degrees. However, the invention is not considered limited to 45 degrees and any angle that provides sufficient clearance can be used and is considered within the scope of the invention. System 10 or 100 can be attached to dolly 250 by any conventional means such as straps, bands, ropes, etc.

In all embodiments, the blade or blades of the spinner assembly can be made relatively shape in order to break and crush various types of lamps and bulbs including, but not limited to, lamps and bulbs with shatterproof coatings. The various motors of the present invention can be provided with on/off switches. All references to hoses can also include other conduits such as piping, tubing, etc. The present invention is not limited to any particular shape(s) or size(s) for the lamps or bulbs.

In the preferred embodiment, drum 20 is conventional and unmodified. Thus, once drum 20 is full lid 112, with all attached components, can be removed and placed on an empty drum 20. The full drum of crushed bulbs and lamps can be labeled and removed in accordance with any relevant laws, codes, regulations, etc.

FIGS. 7 through 11 illustrate a further embodiment for the present invention bulb and lamp crusher or compactor which is generally illustrated as bulb crusher 400. Similar parts of bulb crusher 400 found on the other embodiments discussed above will be numbered similarly and the earlier discussion is incorporated by reference into the discussion for bulb crusher 400. Accordingly, the general operation of bulb crusher 400 is similar to that described above for the other embodiments of the present invention and the below discussion will generally address the differences between bulb crusher 400 and the other discussed embodiments of the present invention.

Initially, bulb crusher 400 can generally sit substantially upright, if not exactly upright. A bulb feeding tube 430 can be disposed approximately at a thirty three degree angle with respect to the lid 412, though other angles are also within the scope of the invention. Thus, an angle position range for feeding tube 430 with respect to lid 412 can be between about twenty degrees to about fifty degrees. Feeding tube 430 preferably consists of a fixed entry tube 432 preferably permanently attached to lid 412 and a preferably removable extender tube 434. Fixed entry tube 432 is preferably an integral part of lid 412 and preferably monolithically formed with lid 412. Extender tube 4334 can have a first end 436 with an inner diameter which is at least slightly larger than an outer diameter of an exposed end 433 of fixed entry tube 432 such that end 433 is received within end 436 of extender tube 434 when securing or fitting extender tube 434 to fixed entry tube 432. For safety purposes, extender tube 434 should be in place with respect to fixed entry tube 432 when bulb crusher 400 is in use. Feeding tube 430 is preferably used when disposing of linear/straight or substantially linear/substantially straight bulbs, such as fluorescent bulbs. An interior area or passageway of fixed entry tube 432 is in communication with an internal area of drum 20 or other housing through a first aperture in lid 412.

A seal stop 440 (FIGS. 7 and 8) can be disposed within exposed end 433 of fixed entry tube 432 when extender tube 434 is removed or on an exposed of extender tube 434 if secured to fixed entry tube 432 when bulb crusher 400 is not is use or is in storage. Seal stop 440 helps to reduce or eliminate residual mercury vapor from escaping out of bulb crusher 400 and potentially contaminating the surrounding air. A securing chain 442 can be attached to seal stop 440 and a portion of lid 412 or fixed entry tube 432 to help prevent seal stop 440 from being lost or misplaced. As an alternative to chain 442, other securing items can be used, including, but not limited to, string, cords, rope, bands, etc. Seal stop 440 can be latched to tube 432 through a lever mechanism.

Figure 7:
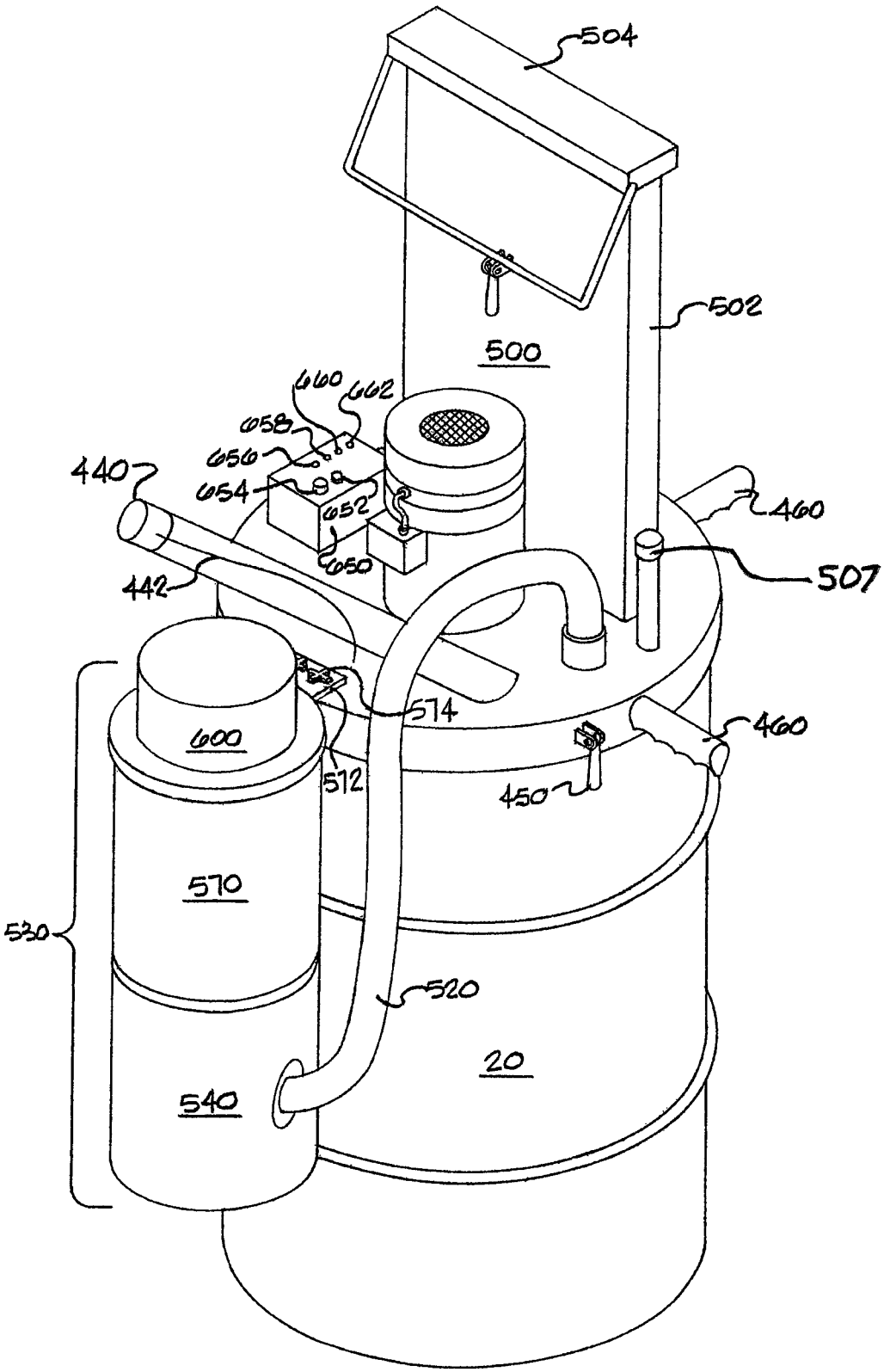
FIG. 7 is a perspective view of a third embodiment of the present invention.
Figure 9:
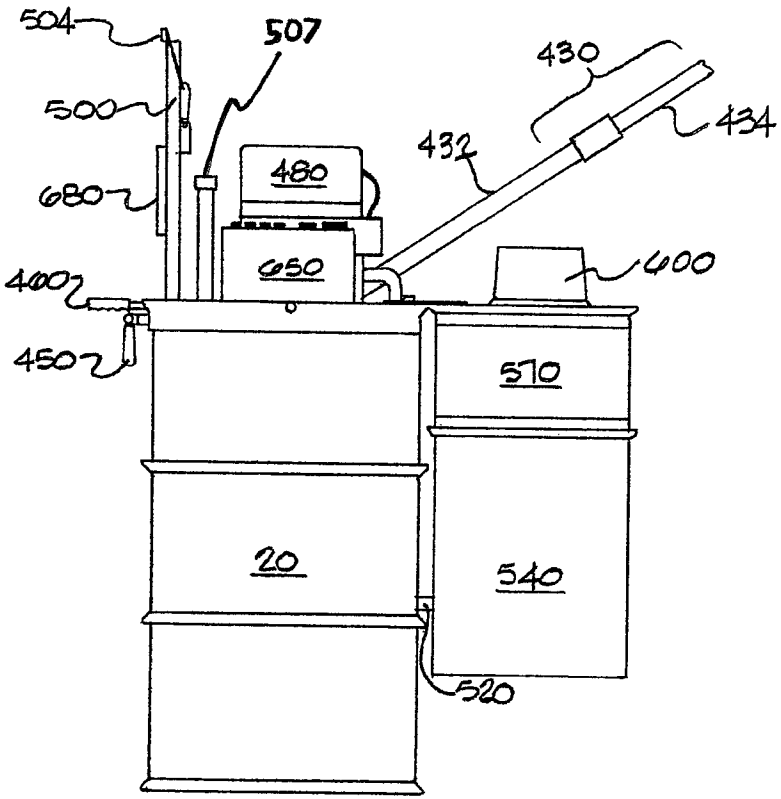
FIG. 9 is a side view of the invention of FIG. 7 with the tube extension feeder attached.
Figure 8:
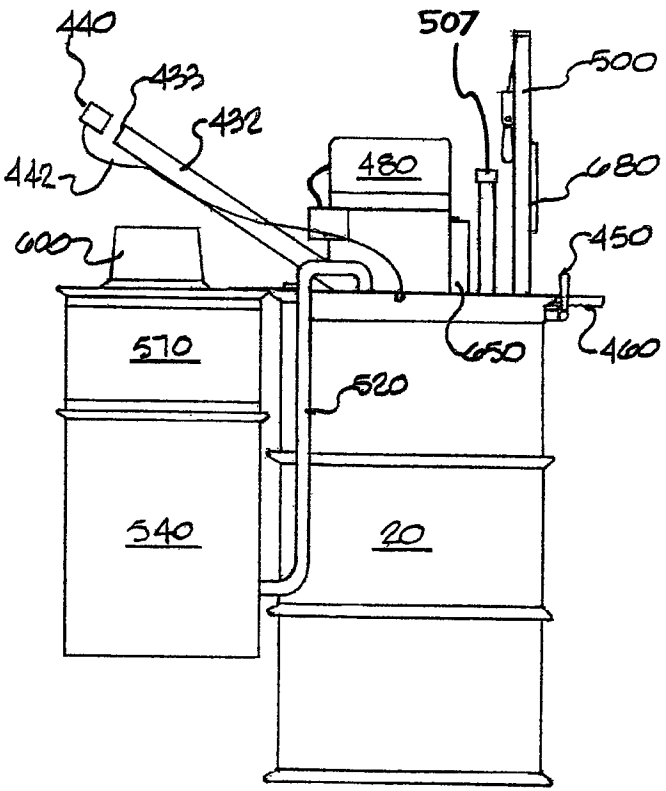
FIG. 8 is a side view of the invention of FIG. 7 without the tube extension feeder.

As with the other embodiments of the present invention, lid assembly 412 can comprise a main part of the bulb crusher 400 and can make an airtight or substantially airtight seal over drum 20 or other housing using to receive the broken bulbs. Lid 412 can be provided with a closed-cell foam rubber gasket on its underside for sealing against an upper lip of drum 20 or other housing (collectively referred to as "drum 20"). One or more clamping knobs 450, and preferably four knobs 450 though not considered limiting, can be located around the outer rim of lid 412 for securing lid 412 to drum 20. Clamping knobs 450 are positioned to a "closed" down position when securing lid 412 to drum 20 (FIGS. 7 and 9). Alternatively, knobs 450 can be configured that the "closed" position occurs by moving the knobs 450 to an up position. To remove lid 412, knobs 450 are moved to their opposite "open" position (FIG. 8) to release the secured or latched attachment of lid 412 to drum 20. Lid assembly 312 can also be provided with one or more lifting handles 460, and preferably four lifting handles 460 though not considered limiting, located around the outer rim of lid 412. In one non-limiting embodiment, lifting handles 460 can be integral or monolithically formed with lid 412. With clamping knobs 450 is an unlocked or open position, lifting handles 460 allow lid 412 to be easily lifted off drum 20, such as when drum 20 needs to be replaced or emptied. Clamping knobs 450 help to provide for proper seating and leak protection between lid 412 and drum 20.

In addition to the motors discussed above for operating the bulb breaking blade, all embodiments of the present invention can be provided with a blade motor having a braking motor. Blade motor 480 can be preferably mounted centrally on lid 412, though such is not considered limiting and other locations on lid 412 are also within the scope of the invention. A shaft of blade motor 480 can extend within an interior area of drum 20 and can have attached thereto a blade designed to pulverize or substantially pulverize the bulbs that enter through feeding tube 430 or the all bulb shape feeding housing or chamber 500. In one non-limiting embodiment, blade 482 can be an durable, tempered steel blade for crushing all types of lamps and bulbs.

Blade motor 480 includes a safe braking motor system, which helps to guard against access to the moving parts of bulb crusher 400. With the inclusion of a braking motor, blade 482 can be caused to stop spinning after a very quick time period, such as, but not limited to, substantially 1.5 revolutions, and thus almost immediately after activating or operating the braking feature.

Figure 10:
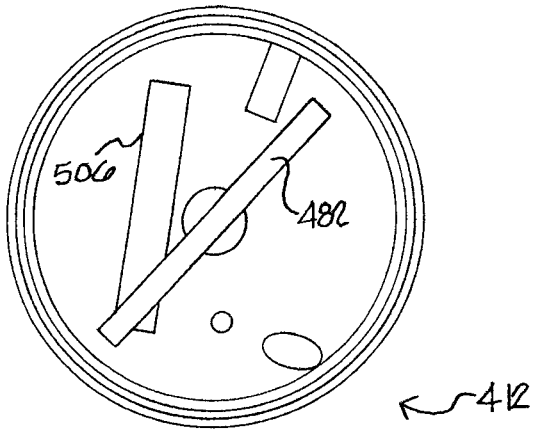
FIG. 10 is a bottom view of the lid assembly of FIG. 7 showing the blade member.
Figure 11:
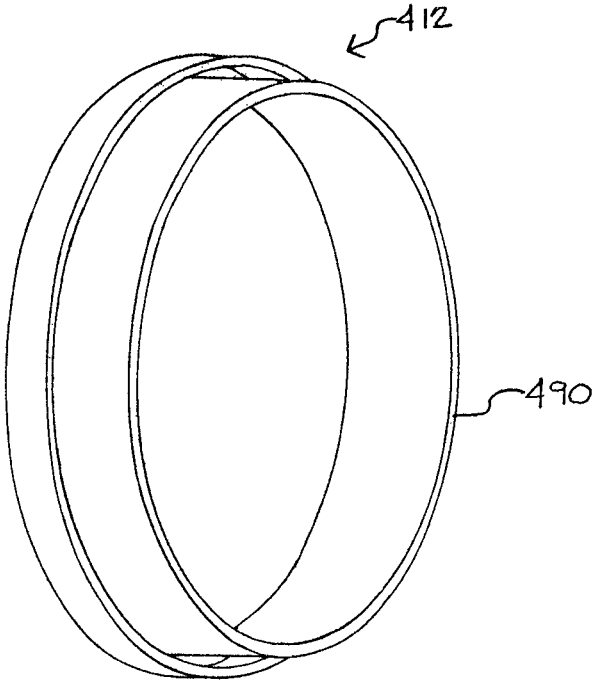
FIG. 11 is a perspective view of the lid assembly of FIG. 7 without blade and motor attached showing the relationship between the lid outer rim or wall and the safety shroud of the lid assembly.

As best seen in FIG. 10, blade 482 is attached to the shaft of blade motor 480 internally of lid 412. Given the length of blade 482 when it is rotating by blade motor 480, blade 482 is can be capable of breaking all bulb types received within drum 20 through either feeding tube 430 or through all bulb shape feeding housing 500. Blade motor 480 can be balanced when manufactured to ease comfort and reduce noise and vibration during use. An internal shroud 490 (best seen in FIG. 11) can be provided and attached to lid 412 and acts as a fixed guard to prevent access to the hazardous area.

Chamber 500, provides a drop in feature, especially, though not limiting, for non-linear shaped or smaller linear shaped bulbs and lamps. Though not considered limiting, some of the types of bulbs and lamps that can be received within chamber 500 include, compact, U-shaped, tight-bend and circline lamps and bulbs. Chamber 500 includes a bulb receiving area 502, which in one embodiment can be rectangular in shape, though such is not considered limiting. Chamber 500 further includes a top door or cover 504 movably associated with a top end of receiving area 502 and a bottom door 506 movably associated with a bottom end of receiving area 502. An internal area of receiving area 502 is in communication with the internal area of drum 20 through a second aperture in lid 412.

When not in use, top door 504 can be shut (FIG. 8), and can be provided with a latch or locking lever mechanism to help maintain its closed/shut position. A gasket can be provided on a bottom surface of top door (preferably around the periphery of top door 504) which abuts a top perimeter end of receiving area 502 for creating an airtight or substantially airtight seal when top door 500 is in a closed position. Once a bulb or lamp is disposed within receiving area 502, top door 504 is shut, preferably latched shut, Bottom door 506 supports the disposed bulb or lamp (collectively referred to as either "bulb" or "lamp") until bottom door is opened by activating (i.e. pushing or pressing down, etc.) a trap or bottom door plunger 507 which is mechanically associated with bottom door 506. With blade 482 spinning, the opening of bottom door 506 through use of the plunger 507 or another mechanism, causes the disposed bulb to enter the internal area of drum 20 and be broken by blade 482.

At the top of receiving area 502, a unique fixed brush can be provided and positioned in a pointing down (preferably at an angle). The inserted bulb can pass through the fixed brush to sit properly within receiving area 502. As a safety enhancement, the angled orientation of the fixed brush makes it difficult to remove an inserted bulb, once the bulb is placed in the chamber beyond the fixed brush, since it would go against the direction of the brush.

In one embodiment, the plunger 507 can be a push rod assembly that is pushed by the operator to open bottom door 506 which permits the disposed bulb to pass into the top internal area of drum 20 (i.e. crushing chamber). Where the top door with gasket is secured shut, the integrity of chamber 500 can be insured for the containment of Mercury vapor and for the prevention of any Glass shards flying out during the crushing action. A vacuum vacating tube can be built into the chamber to ensure consistent negative pressure at all times during the compacting operation of the bulbs. A vacuum hose 520 can be connected to an exhaust port locating on lid 412 (i.e. the top of lid 412, etc.) and an inlet port of a lower tank assembly module 540 of a filter module 530.

Filter module 530 can be made up of three separate detachable modules, though being detachable and the number of separate modules is not considered limiting. In the preferred embodiment, the three modules include a lower tank assembly module 540, an activated carbon filter module 570 and a vacuum unit 600. Lower tank assembly 540 can be latched or otherwise removably attached to activated carbon filter module 570.

Lower tank assembly 540 can retain a paper collection bag and a high efficiency particulate air ("HEPA") filter module which includes a Dacron bag and a pre filter (preferably pink, though such is not considered limiting). The prefilter can be fitted to the bottom of the HEPA filter. The paper collection bag can collect dry contaminated particulate and contaminated debris from contaminated air within drum 20 that is drawn up through vacuum hose 520 under negative pressure. The paper collection bag can be disposed at the bottom of lower tank assembly 540 and can be provided with a cardboard/rubber collar that is disposed over an inlet port inside lower tank assembly 540, such as, but not limited to, pulling the collar over a rib located on the inlet port. The contaminated air enters lower tank assembly 540 through the inlet port of assembly 540 where it enters into the paper collection bag, which can be disposable. The paper collection bag can be considered the first stage of the filtering process. The second stage can be considered the non-clinging Dacron bag which covers and protects the HEPA filter module. A pre-filter HEPA filter can be separate and reside between Lower Tank Assembly 540 and Activated Carbon Filter Module 570. The pre-filter, which can be pink, helps to provide smooth air flow through the HEPA filter. The Dacron bag can be disposed over the HEPA filter and the prefilter. The Dacron bag can be provided with an elastic band that rests securely over a rim of the HEPA filter module. The HEPA filter module can be provided with a built-in micro impact filter to help protect and extend the life of the HEPA filter. The HEPA filter removes approximately 99.97% of all fine particulates up to approximately 0.3 microns from the air stream. The HEPA filter module can be disposed on the rim of lower tank assembly 540, and can be provided with a sealing gasket that sits on the lip on lower tank assembly 540. The HEPA filter module can be disposable.

The next stage of the filter can be Activated Carbon Filter module 570 designed to trap mercury vapor. Module 570 can be a self-contained high capacity activated carbon filter module. Module 570 can be provided with a bracket 572 with one or more (preferably two) apertures for insertion therethrough of a corresponding number of stud bolts in order to attach module 570 to be attached to lid 412. A corresponding number of knobs 574, nuts, caps, etc. are secured to the bolts to maintain the attachment of module 570 to lid 412. The stud bolts, or similar bolts or structure, can be permanently fixed to the top of lid 412. Activated Carbon Filter module 570 can be disposable. Knobs 574 can be fully hand tightened for securing filter module 570 to lid 412.

The final stage of the filter can be vacuum unit 600 which creates a vacuum within the system. Vacuum unit 600 can be latched on top of or otherwise removably secured to activated carbon filter module 570. The power lead or cord to vacuum unit 600 can be detachable from its associated socket on a control box 650. The power cord can be provided with a twist lock socket on the control box connector. The power lead can be detached when removing the filter module from lid 412. Vacuum unit 600 can be provided with an indicator, such as lamp indicator (i.e. red lamp indicator) that can illuminate when a filter component needs replacing or cleaning, one or more filters have become saturated and/or there is a blockage in the system.

The present invention provides an industrial grade filtration module and high output vacuum system for effective and efficient processing of all types of fluorescent bulbs, including, but not limited to, mercury vapor and high pressure sodium lamps. The mercury rated vacuum can consist of a modular canister construction and filtration system. The unit can be operated under negative air pressure at all critical filtration points to help ensure more efficient mercury extraction. The charcoal canister can be rated at between approximately three and approximately four million lamps and method of charcoal absorption is selected for increased filter life and efficiency.

For operating bulb crusher 400, control box 650 can be provided and includes a start button 652 and a safety stop button 654. Stop button 654 can be of a latching type, requiring resetting once stopped. Control box 650 can also be provided with one or more illuminated indicator lights or lamps, such as, but not limited to, "Power On" 656 (which can be green in color), "Lid Open" 658 (which can be red in color), "Full Drum" 660 (which can be red in color, and "Drum Open Delay" 662 (which can be amber in color). Other colors can be used and are considered within the scope of the invention. Furthermore, appropriate circuitry is also associated with these various lamps for determining when or when not to illuminate such lamps. Control box /bulb crusher 400 can be powered by any conventional means now known or later developed such as, but not limited to, AC power source, etc.

The "Full Drum" indicator advises when drum 20 or other final collection container is full or at a threshold level for emptying. The "Open Drum" indicator and circuitry will shut crusher 400 off if lid 412 having the bulb crushing unit is lifted or is begun to be lifted off drum 20. A sensor configuration is provided that works in conjunction with the internal safety shroud. The shroud ensures that there is no chance that the blade is exposed prior to the sensor shutting the system down. The shroud can extend approximately nine inches (or another sufficient length) down into the crushing chamber such that blade 482 is not exposed while it is moving. The electronics of the present invention can also allow the vacuum motor to continue to run for approximately 35 seconds (or some other desired time period) after the crushing motor has shut off. This helps to allow the drum and crushing chamber to be completely vacated of any mercury.

A storage cabinet 680 can also be provided, such as, but not limited to, an outer surface of drop in chamber 500. Cabinet 680 allows for the storage of paper collection bags, protective equipment, operating or instructional manuals, first aid items, etc.

In summary, bulb crusher 400 compacts and safely contains all types of fluorescent bulbs and at the same time recovers virtually all of the harmful mercury vapors emitted from fluorescent bulbs. Bulb crusher 400 pulverizes the fluorescent bulbs into tiny pieces that are collected within a standard drum 20 or other collecting receptacle. A standard 55-gallon drum can store approximately 425-2400 crushed bulbs dependent on type and width. When the drum is full it can be sealed and sent to a hazardous waste disposal facility. The harmful mercury vapor released during the bulb crushing process is drawn through a series of filter, including an activated carbon filter module that captures and permanently absorbs virtually all of the mercury vapors emitted.

Bulb crusher 400 can handle the disposal of all types of fluorescent bulbs including all widths and lengths of linear bulbs and all types of non-linear bulbs including, but not limited to, compact fluorescent, tight-bend and circline lamps. Crusher 400 includes lid assembly 412 and a filter module. The drum is used to collect and store crushed bulbs. Lid assembly 412 is sealed over the drum to prevent any mercury vapors from escaping. Lid assembly 412 can be secured or fixed in place by clamping knobs (preferably four) located around the outer rim of lid 412. A closed cell foam rubber gasket can be provided on the underside of lid 412 to help ensure a proper seal. Lid 412 includes mounted motor (preferably centrally mounted) having a blade mounted to the shaft on the underside of lid 412 inside the sealed drum. The rotating blade immediately destroys the lamps as soon as they are fed into bulb crusher 400 either through entry tube 430 or chamber 500 depending on the size and shape of the bulb. A vacuum hose is secured to the top of lid 412 via an exhaust port. Contaminated gases are drawn through the hose into a multi-stage filter under negative pressure, exhausting clean air into the environment. When using entry tube 430, the bulbs are preferably fed at an angle which allows the drum to remain upright and fill evenly. An optional transport dolly can also be provided for moving the drum when full.

Accordingly, while there has been shown the preferred embodiment of the present invention, it is to be understood that the invention may be embodied otherwise than is herein specifically shown and described and that within said embodiments certain changes may be made in the forms and arrangements of the parts without departing from the underlying ideas or principles of this invention and such variations are also incorporated by reference and are also considered within the scope of the invention.

What is claimed is:

1. A fluorescent lamp compactor having a drum including a lid and at least one lamp receiving device, a spinning blade to substantially crush a lamp, and a multi-stage filtering system having at least a first filter and a final filter, wherein the improvement comprises:

a shroud extending outwardly from the lid and encircling the spinning blade such that a generally uniform gap is maintained between the shroud and a peripheral rim of the lid, the shroud being disposable within the drum to encircle the spinning blade;

a motor adapted to selectively power the spinning blade, the motor including a safety braking mechanism adapted to stop the spinning blade from spinning more quickly than if the blade freewheeled to a stop; and a vacuum assembly adapted to create a negative pressure vacuum through all stages of the multi-stage filtering system, the vacuum assembly including;

a vacuum motor positioned after and in operative communication with the final filter of the multi-stage filtering system, wherein the first filter is in operative communication with the drum such that the negative pressure vacuum is created to draw vapors from the substantially crushed lamp at least into the first filter, out the first filter and operatively to the final filter, and out of the final filter to expel substantially clean air out from the vacuum assembly.

2. The fluorescent lamp compactor of claim 1, wherein the safety braking mechanism can substantially stop the spinning blade after approximately 1.5 revolutions.

3. The fluorescent lamp compactor of claim 1, further including one or more clamping devices operatively disposed on a portion of the drum to facilitate access into and closing off of the drum.

4. A fluorescent lamp compactor having a drum including a lid and at least two lamp receiving devices, a motored blade to substantially crush a lamp, and a multi-stage filtering system having at least a first filter and a final filter, wherein the improvement comprises:

an external actuation member in mechanical communication with a bottom door of one of the at least two lamp receiving devices to selectively mechanically activate the bottom door to permit advancement of a lamp to the motored blade to substantially crush the lamp;

a shroud extending outward from the lid past and generally along the profile of a peripheral rim of the lid such that the shroud is disposable within the drum to encircle the motored blade; and a vacuum assembly adapted to create a negative pressure vacuum across all stages of the multi-stage filtering system, the vacuum assembly including;

a vacuum motor positioned after and in operative communication with the final filter of the multi-stage filtering system, wherein the first filter is in operative communication with the drum such that the negative pressure vacuum is created to draw vapors from the substantially crushed lamp at least into the first filter, out the first filter and operatively to the final filter, and out of the final filter to expel substantially clean air out from the vacuum assembly.

5. The fluorescent lamp compactor of claim 4, further comprising a safety braking mechanism in operative communication with the motored blade, the safety braking mechanism configured to brake the motored blade to a stop more quickly than a freewheeling blade would brake to a stop.

6. The fluorescent lamp compactor of claim 5, wherein the safety braking mechanism can substantially stop the blade from spinning after approximately 1.5 revolutions.

7. The fluorescent lamp compactor of claim 4, further including one or more clamping devices operatively disposed on a portion of the drum to facilitate access into and closing off of the drum.

8. The fluorescent lamp compactor of claim 4, wherein the external actuation member comprises a push rod assembly.

9. The fluorescent lamp compactor of claim 8, wherein the push rod assembly is configured to open the bottom door via a downward stroke of a plunger.

10. The fluorescent lamp compactor of claim 4, wherein the external actuation member comprises a plunger extending outwardly of the lid.

11. The fluorescent lamp compactor of claim 10, wherein the plunger extends outwardly of the lid in substantially a vertical direction.

12. A fluorescent lamp compactor having a drum including a lid and a lamp receiving device, a motored blade to substantially crush a lamp, and a multi-stage filtering system having at least a first filter and a final filter, wherein the improvement comprises:

an external actuation member in mechanically linked with a bottom door of the lamp receiving device to open the bottom door to permit advancement of a lamp to the motored blade to substantially crush the lamp;

a safety braking mechanism in operative communication with the motored blade, the safety braking mechanism configured to brake the motored blade to a stop more quickly than a freewheeling blade would brake to a stop; and a vacuum assembly adapted to create a negative pressure vacuum across all stages of the multi-stage filtering system and to expel substantially clean air out from the vacuum assembly.

13. The fluorescent lamp compactor of claim 12, wherein the safety braking mechanism can substantially stop the blade from spinning after approximately 1.5 revolutions.

14. The fluorescent lamp compactor of claim 12, wherein the external actuation member comprises a push rod assembly.

15. The fluorescent lamp compactor of claim 14, wherein the push rod assembly is configured to open the bottom door via a downward stroke of a plunger.

16. The fluorescent lamp compactor of claim 12, wherein the external actuation member comprises a plunger extending outwardly of the lid.

17. The fluorescent lamp compactor of claim 16, wherein the plunger extends outwardly of the lid in substantially a vertical direction.

* * * * *